US009631435B2

(12) United States Patent
Garner et al.

(10) Patent No.: US 9,631,435 B2
(45) Date of Patent: Apr. 25, 2017

(54) MATRIX FIXED CUTTER DRILL BITS AND METHODS FOR MANUFACTURING SAME

(71) Applicant: National Oilwell DHT, L.P., Conroe, TX (US)

(72) Inventors: Michael Garner, Conroe, TX (US); Jan Edgar Marshall, Conroe, TX (US); Harold A. Sreshta, Conroe, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 625 days.

(21) Appl. No.: 14/101,795

(22) Filed: Dec. 10, 2013

(65) Prior Publication Data

US 2015/0159440 A1 Jun. 11, 2015

(51) Int. Cl.

| | |
|---|---|
| ***E21B 10/43*** | (2006.01) |
| ***E21B 10/54*** | (2006.01) |
| ***E21B 10/42*** | (2006.01) |

(52) U.S. Cl.

CPC ..... *E21B 10/43* (2013.01); *E21B 10/42* (2013.01); *E21B 10/54* (2013.01)

(58) Field of Classification Search

CPC ..... E21B 10/54; E21B 10/42; E21B 10/43; E21B 10/55; E21B 10/61; E21B 10/46; E21B 10/567; E21B 10/573; E21B 10/602; E21B 10/62; B22F 2005/001

See application file for complete search history.

(56) References Cited

U.S. PATENT DOCUMENTS

| | | | | | |
|---|---|---|---|---|---|
| 2,506,388 | A * | 5/1950 | Ross | E21B 10/48 | 175/384 |
| 3,382,940 | A * | 5/1968 | Stebley | E21B 10/40 | 175/426 |
| 4,190,126 | A * | 2/1980 | Kabashima | E21B 10/006 | 175/379 |
| 4,323,130 | A * | 4/1982 | Dennis | E21B 10/567 | 175/393 |
| 4,442,909 | A | 4/1984 | Radtke | | |
| 4,492,277 | A * | 1/1985 | Creighton | E21B 10/43 | 175/393 |
| 4,545,441 | A * | 10/1985 | Williamson | E21B 10/43 | 175/431 |
| 5,433,280 | A * | 7/1995 | Smith | B22F 3/1055 | 175/336 |
| 5,732,783 | A | 3/1998 | Truax et al. | | |

(Continued)

OTHER PUBLICATIONS

International Patent Application No. PCT/US2014/072182 International Search Report and Written Opinion dated Jun. 24, 2015 (11 pages).

*Primary Examiner* — Daniel P Stephenson
(74) *Attorney, Agent, or Firm* — Conley Rose, P.C.

(57) ABSTRACT

A fixed cutter drill bit for drilling a borehole in earthen formations includes a blank assembly and a matrix crown fixably mounted to the blank assembly. The blank assembly includes an annular mandrel and a plurality of elongate studs fixably coupled to the mandrel. The mandrel has a first end distal the crown and a second end engaging the crown. In addition, the mandrel includes a plurality of bores extending axially from the second end. Each elongate stud has a first end disposed within one of the bores and a second end disposed in the crown distal the mandrel.

8 Claims, 13 Drawing Sheets

(56) References Cited

U.S. PATENT DOCUMENTS

| | | | | |
|---|---|---|---|---|
| 6,338,390 | B1 * | 1/2002 | Tibbitts | E21B 7/24 175/381 |
| 6,460,631 | B2 * | 10/2002 | Dykstra | E21B 10/42 175/428 |
| 7,472,764 | B2 * | 1/2009 | Zahradnik | B23K 31/02 175/374 |
| 8,684,111 | B2 * | 4/2014 | Bell | E21B 10/48 175/403 |
| 2005/0183892 | A1 * | 8/2005 | Oldham | E21B 7/20 175/402 |
| 2006/0213693 | A1 * | 9/2006 | Zahradnik | B23K 31/02 175/374 |
| 2010/0163310 | A1 * | 7/2010 | Vempati | E21B 10/43 175/57 |
| 2011/0174546 | A1 * | 7/2011 | Bell | E21B 10/48 175/246 |
| 2011/0209922 | A1 | 9/2011 | King et al. | |
| 2012/0318580 | A1 * | 12/2012 | Oesterberg | E21B 7/064 175/57 |
| 2013/0092453 | A1 | 4/2013 | Johnson | |
| 2013/0247475 | A1 | 9/2013 | Lind et al. | |
| 2015/0159440 | A1 * | 6/2015 | Garner | E21B 10/43 175/428 |

* cited by examiner

MATRIX FIXED CUTTER DRILL BITS AND METHODS FOR MANUFACTURING SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The present disclosure relates generally to earth-boring drill bits for drilling a borehole for the ultimate recovery of oil, gas, or minerals. More particularly, the present disclosure relates to fixed cutter bits including a modular blank assembly and methods for manufacturing fixed cutter bits with a modular blank assembly.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill wellbores. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Fixed cutter bits are conventionally either machined from steel or made of a hard metal cast matrix formed in a mold with a bit blank disposed in the mold. For matrix bits, the mold must be created or machined and the bit blank is made from steel or other suitable material is prepared and disposed within the mold cavity. The bit blank provides reinforcement to the bit body matrix and accommodates spacers (e.g., sand castings) that define drilling fluid passages through the bit body. In general, the spacers are positioned in the mold (along with the bit blank) during formation of the bit body, and the spacers are removed after formation of the bit body to leave drilling fluid passages in the bit body. The bit blanks are individually custom designed and created, and often need to be completely remade when minor changes to the drill bit design are made. Further, the bit blank must be precisely positioned within the mold to ensure the proper placement of the spacers for drilling fluid passages.

A quantity of particulate material is then introduced to the mold to form the bit body matrix. The bit body is then either heated or molten metal is introduced to the particulate material, forming a solid bit body. The bit body may then be attached or secured to other drill bit components through welding, and cutting elements may be secured to the bit body by brazing, adhesive bonding, or other mechanical means. Thus, the process of manufacturing a particulate-based drill bit is complex, lengthy, time intensive, and costly. Furthermore, the associated thermal impact of the manufacturing processes can cause thermal stress and cracking to develop in the bit body. When the bit body is being heated, the steel of the blank tries to expand while the matrix material does not, which puts tensile stress around the matrix and creates hoop stress. When the bit body begins to cool down after welding or brazing, the blank tries to shrink, but the matrix material restrains it putting further pressure on the interior matrix.

BRIEF SUMMARY OF THE DISCLOSURE

The embodiments described herein are generally directed to a fixed cutter drill bit for drilling a borehole in earthen formations. The bit has a central axis and a cutting direction of rotation. In addition, the bit comprises a blank assembly and a matrix crown fixably mounted to the blank assembly. The blank assembly includes an annular mandrel and a plurality of elongate studs fixably coupled to the mandrel. The mandrel is coaxially aligned with the central axis and has a first end distal the crown and a second end engaging the crown. Further, the mandrel includes a plurality of bores extending axially from the second end. Each elongate stud has a first end disposed within one of the bores and a second end disposed in the crown distal the mandrel.

In an embodiment, a blank assembly for a fixed cutter drill bit comprises an annular mandrel having a central axis, a first end, and a second end axially opposite the first end. The mandrel includes a plurality of parallel bores extending axially from the second end. Further, the blank assembly comprises a plurality of elongate studs is fixably secured to the mandrel. Each stud has a first end seated in one of the bores and a second end distal the mandrel.

In an embodiment, a method for manufacturing a fixed cutter drill bit comprises (a) securing a plurality of elongate studs to an annular mandrel to form a blank assembly. In addition, the method comprises (b) positioning the second end of the mandrel and the studs extending therefrom in a mold. Further, the method comprises (c) at least partially filling the mold with a matrix material. Still further, the method comprises (d) applying heat to the mold and the matrix material after (b) and (c). Moreover, the method comprises (e) forming a rigid crown secured to the blank assembly. The mandrel has a central axis, a first end, and a second end. Each stud extends from the second end of the mandrel.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the disclosure, reference will now be made to the accompanying drawings in which.

DETAILED DESCRIPTION OF THE PREFERRED EMBODIMENTS

Figure 1:
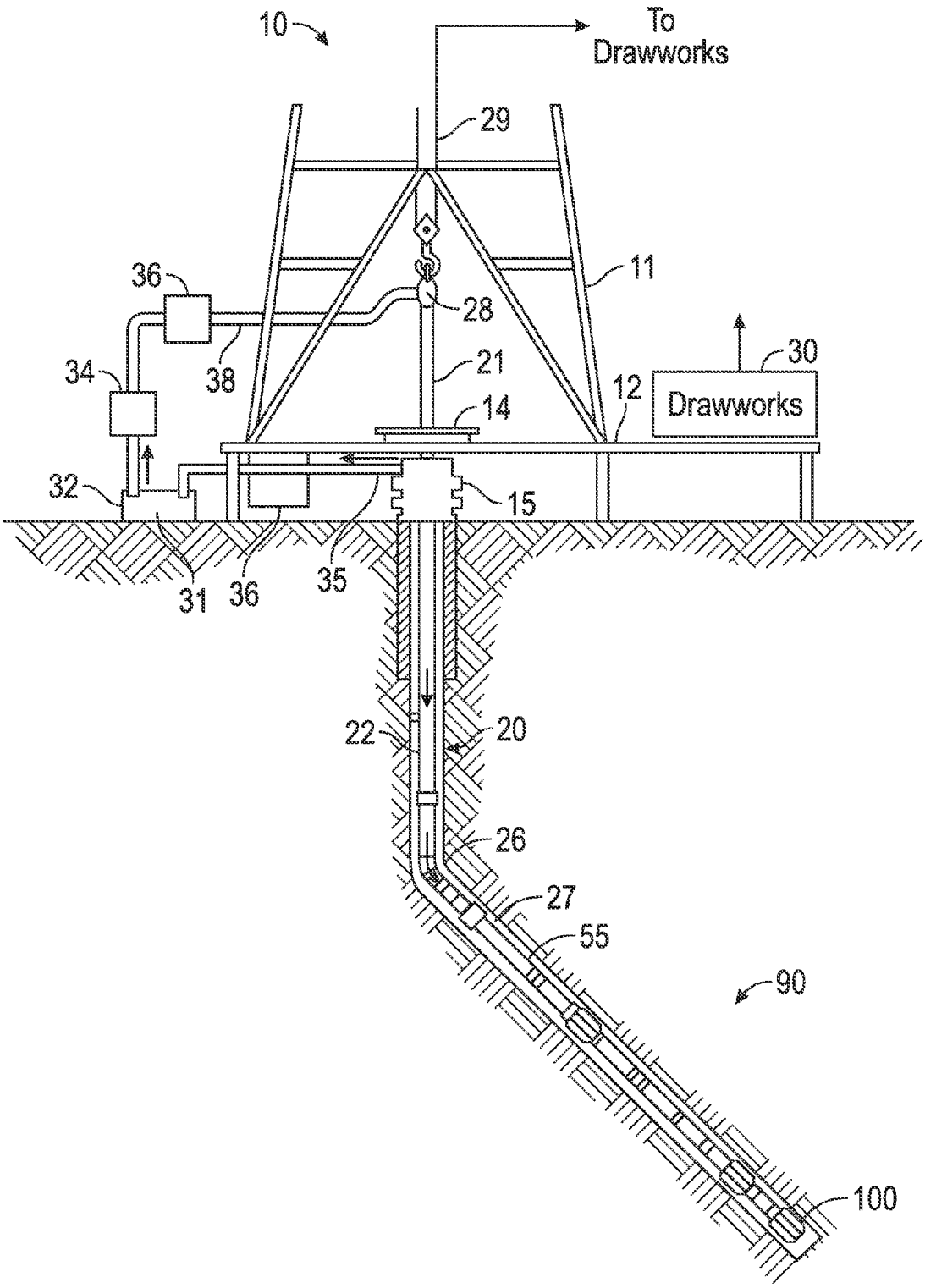
FIG. 1 is a schematic partial cross-sectional view of a drilling system including an embodiment of a drill bit made in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

Certain terms are used throughout the following description and claims to refer to particular system components. This document does not intend to distinguish between components that differ in name but not function. Moreover, the drawing figures are not necessarily to scale. Certain features of the disclosure may be shown exaggerated in scale or in somewhat schematic form, and some details of conventional elements may not be shown in the interest of clarity and conciseness. Further, some drawing figures may depict vessels in either a horizontal or vertical orientation; unless otherwise noted, such orientations are for illustrative purposes only and is not a required aspect of this disclosure.

In the following discussion and in the claims, the terms "including" and "comprising" are used in an open-ended fashion, and thus should be interpreted to mean "including, but not limited to . . . ." Also, the terms "couple", "attach", "connect" or the like are intended to mean either an indirect or direct mechanical or fluid connection, or an indirect, direct, optical or wireless electrical connection. Thus, if a first device couples to a second device, that connection may be through a direct mechanical or electrical connection, through an indirect mechanical or electrical connection via other devices and connections, through an optical electrical connection, or through a wireless electrical connection. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis. Any reference to up or down in the description and the claims will be made for purpose of clarification, with "up", "upper", "upwardly", or "upstream" meaning toward the surface of the well and with "down", "lower", "downwardly", or "downstream" meaning toward the terminal end of the well, regardless of the well bore orientation. In some applications of the technology, the orientations of the components with respect to the surroundings may be different. For example, components described as facing "up", in another application, may face to the left, may face down, or may face in another direction.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). The motor controller may be a silicon controlled rectifier (SCR) system, a Variable Frequency Device (VFD), or other type of suitable controller. In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15 into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
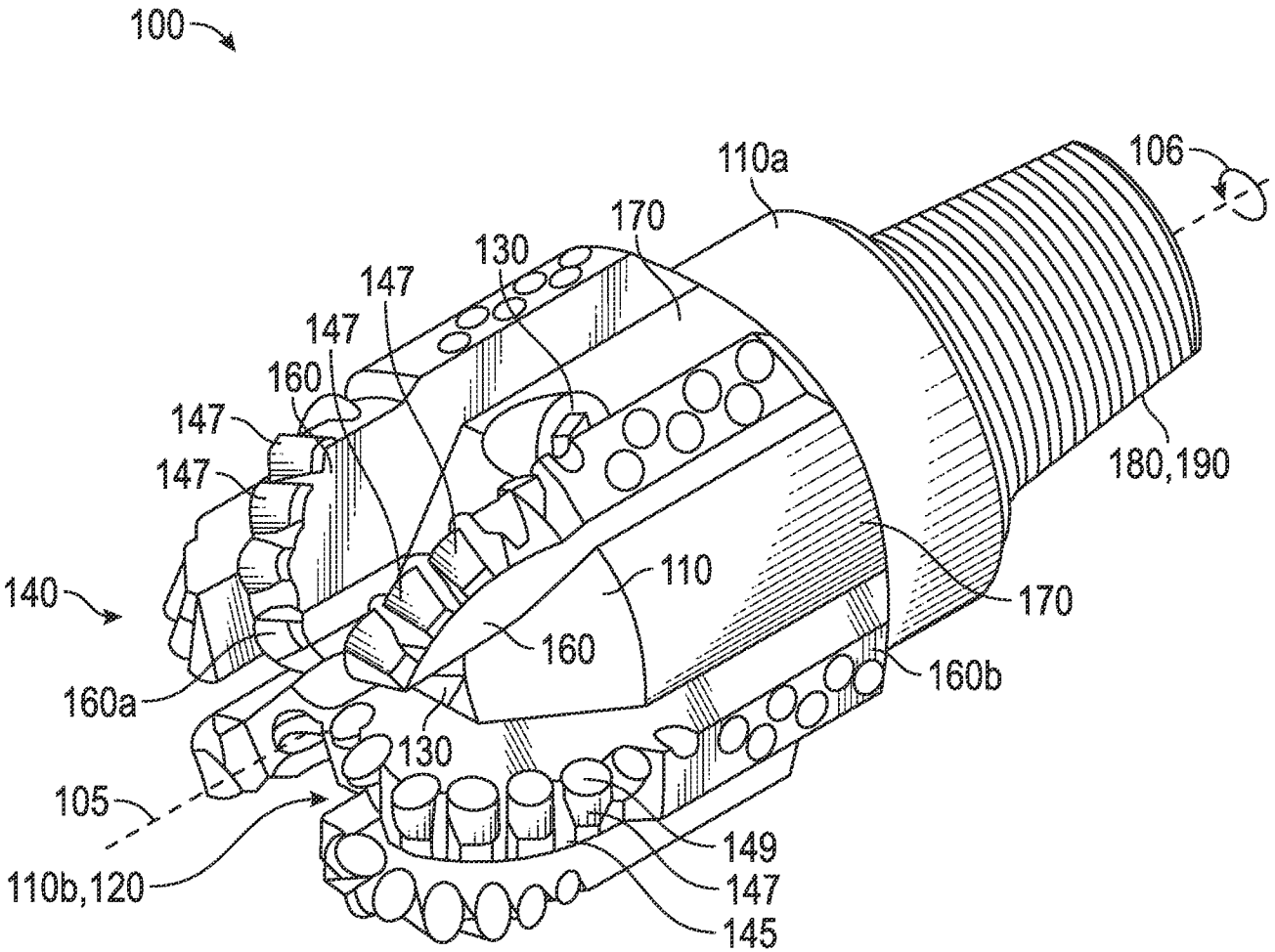
FIG. 2 is a perspective view of the drill bit shown in FIG. 1.
Figure 3:
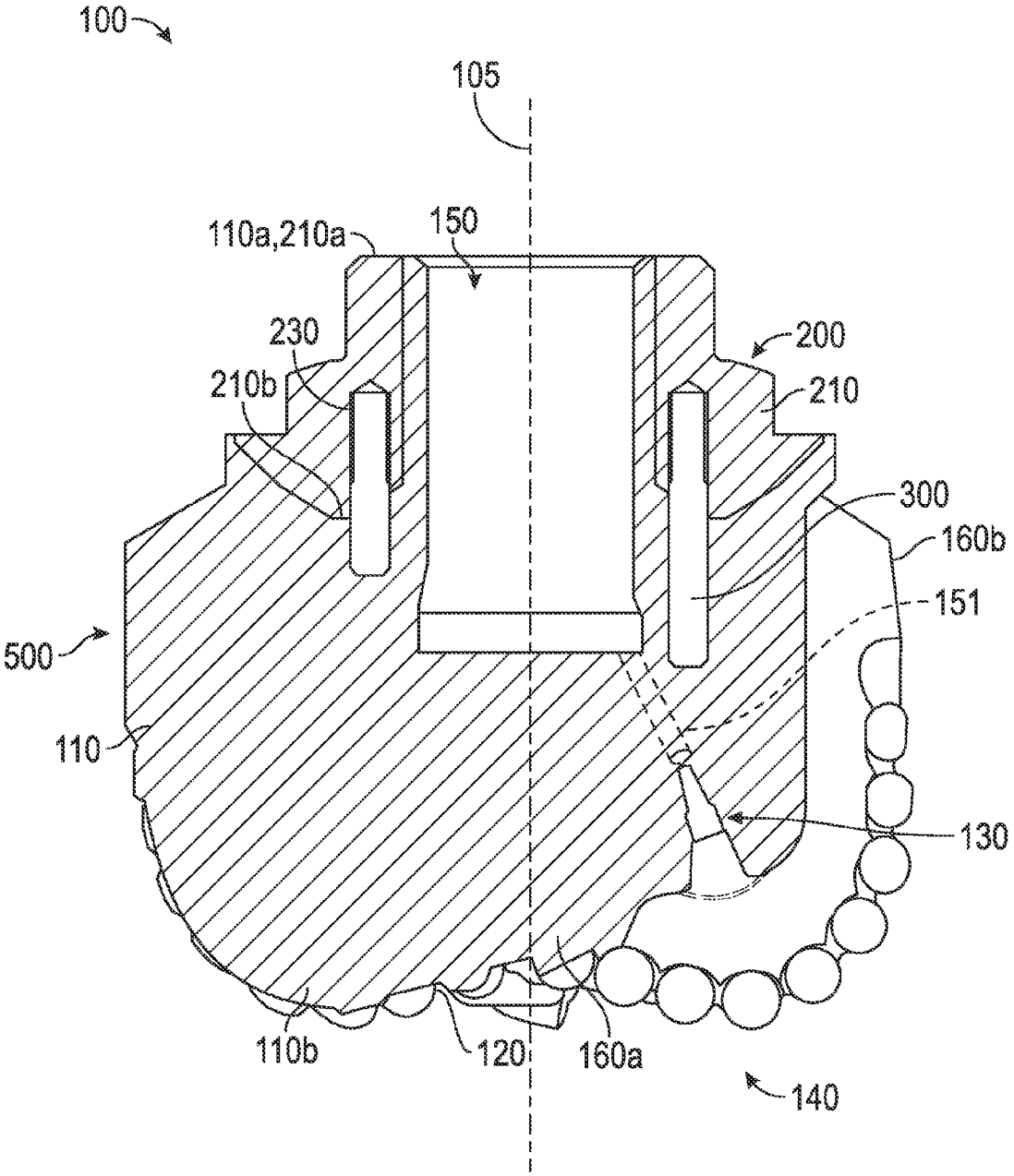
FIG. 3 is a cross-sectional partial view of the drill bit of FIG. 2.

Referring now to FIGS. 2 and 3, drill bit 100 is a fixed cutter bit, sometimes referred to as a drag bit, and more specifically is a PDC bit adapted for drilling through formations of rock to form a borehole. In this embodiment, bit 100 includes a bit body 110 and a connection member 190 (FIG. 2) coupled to bit body 110. In this embodiment, connection member 190 is a pin end connector for securing bit 100 to the lower end of drillstring 20. Bit 100 has a central or longitudinal axis 105 about which bit 100 rotates in the cutting direction represented by arrow 106. Bit body 110 and connection member 150 are coaxially aligned with axis 105. Thus, bit body 110 and connection member 150 each have a central axis coincident with axis 105.

Body 110 has a first or upper end 110*a* coupled to connection member 190 and a second or lower end 110*b* defining a bit face 120 comprising a cutting structure 140 for engaging the formation. In addition, bit body 110 includes a central bore or passage 150 extending from upper end 110*a* and a plurality of bores and/or passages 151 extending from central passage 150 to bit face 120. A port or nozzle 130 is disposed at the lowermost ends of each passage 151 at bit face 120. Passages 150, 151 provide a flow path for drilling fluid or mud to flow from the drill string 20 through bit 100, and out of bit face 120 through nozzles 130. The drilling fluid emitted from nozzles 130 serve to distribute drilling fluid around cutting structure 140 to flush away metal cuttings during milling or formatting cuttings during drilling through the formation, and to remove heat from bit 100.

Referring still to FIGS. 2 and 3, cutting structure 140 is provided on bit face 120 and includes a plurality of circumferentially-spaced blades 160 extending along bit face 120. Blades 160 are integrally formed as part of, and extend perpendicularly outwardly from body 110 and bit face 120. In addition, blades 160 extend generally radially across bit face 120 and longitudinally along a portion of the periphery of bit 100. Each blade 160 has a first or radially inner end 160*a* at or proximal axis 105 and a second or radially outer end 160*b* opposite end 160*a* proximal end 110*a*. Blades 160 are separated by fluid flow courses 170.

Each blade 160 on bit face 120 provides a cutter-supporting surface 145 to which a plurality of cutter elements are mounted. In this embodiment, a plurality of cutter elements 147 having cutting faces 149 are mounted to cutter-supporting surface 145 of each blade 160. Cutter elements 147 are generally arranged in rows extending along each blade 160. Cutter elements 147 are mounted so that their cutting faces 149 are forward facing. As used herein, "forward facing" is used to describe the orientation of a surface that is substantially perpendicular to or at an acute angle relative to the cutting direction 106 of bit 100. For instance, a forward facing cutting face 149 may be oriented substantially perpendicular to the cutting direction of bit 100, may include a backrake angle, and/or may include a siderake angle. Each cutter element 147 is a conventional cutter element. In particular, each cutter element 147 comprises an elongated and generally cylindrical tungsten carbide support member or substrate which is received and secured in a pocket formed in the surface of the blade 160 to which it is fixed, and each cutting face 149 comprises a forward facing disk or tablet-shaped, hard cutting layer of polycrystalline diamond or other superabrasive material is bonded to the exposed end of the corresponding support member.

As best shown in FIG. 3, in this embodiment, bit body 110 includes a modular bit blank assembly 200 and a crown 500 fixably mounted thereto. Bit blank assembly 200 extends axially from and defines upper end 110*a* and crown 500 extends axially from and defines lower end 110*b*. As will be described in more detail below, crown 500 is formed in a conventional manner using powdered metal tungsten carbide particles in a binder material to form a hard metal cast matrix secured to blank assembly 200. For the purposes of describing the modular blank assembly 200, any reference to upward or upper means toward end 110*a* and any reference to downward or lower means toward end 110*b*.

Figure 4:
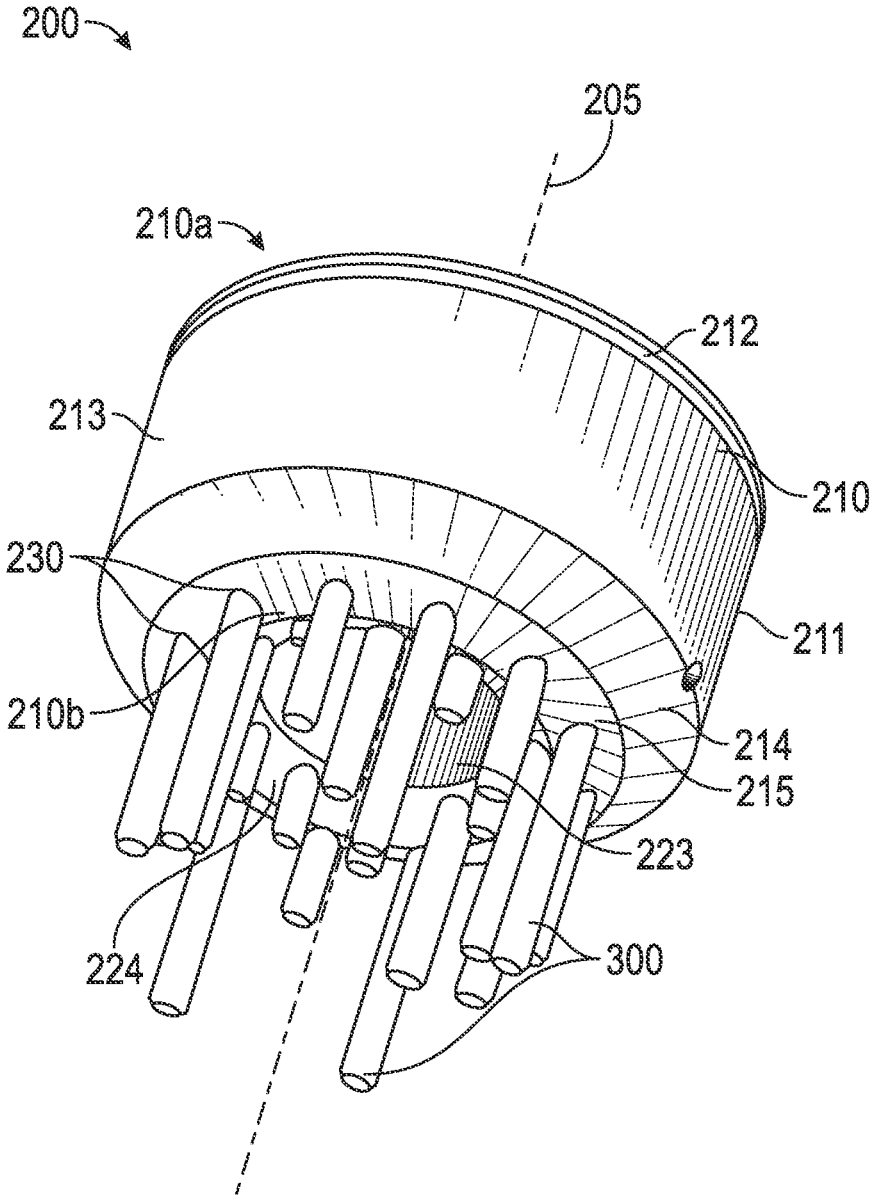
FIG. 4 is a perspective view of the modular bit blank assembly of FIG. 3.
Figure 5:
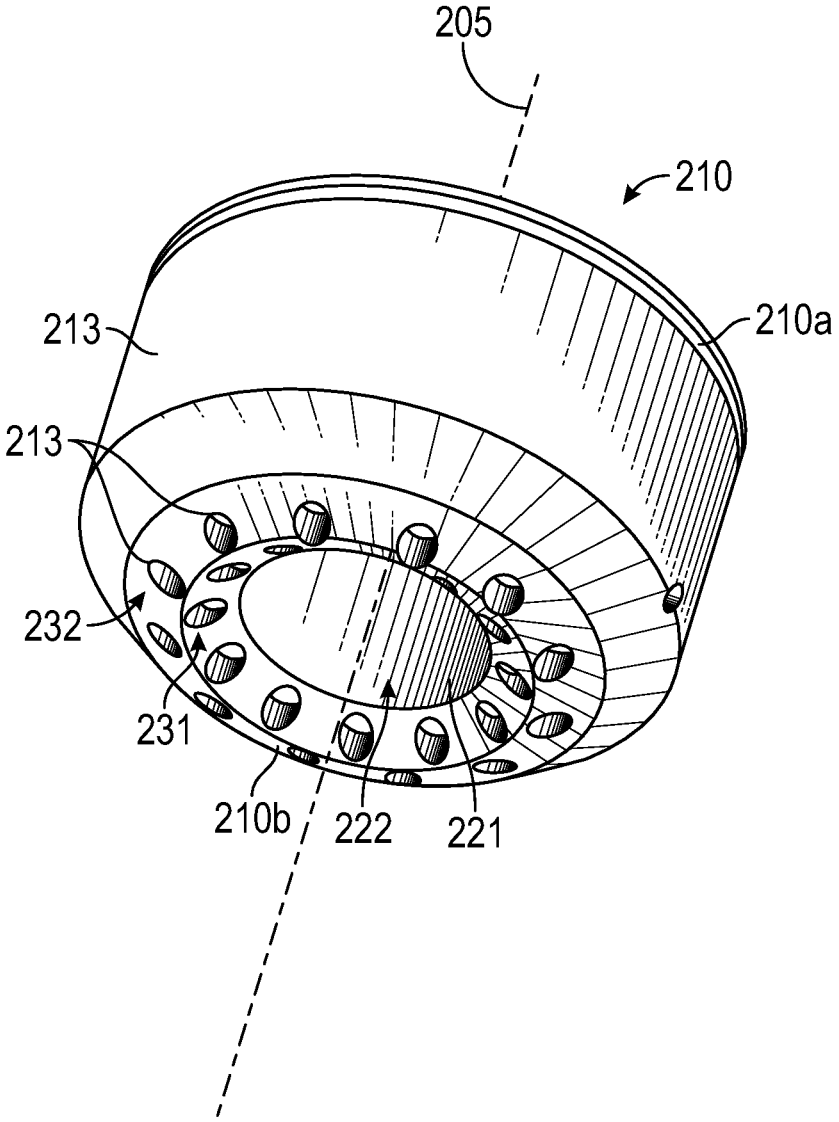
FIG. 5 is a perspective view of the mandrel of FIG. 4.
Figure 6:
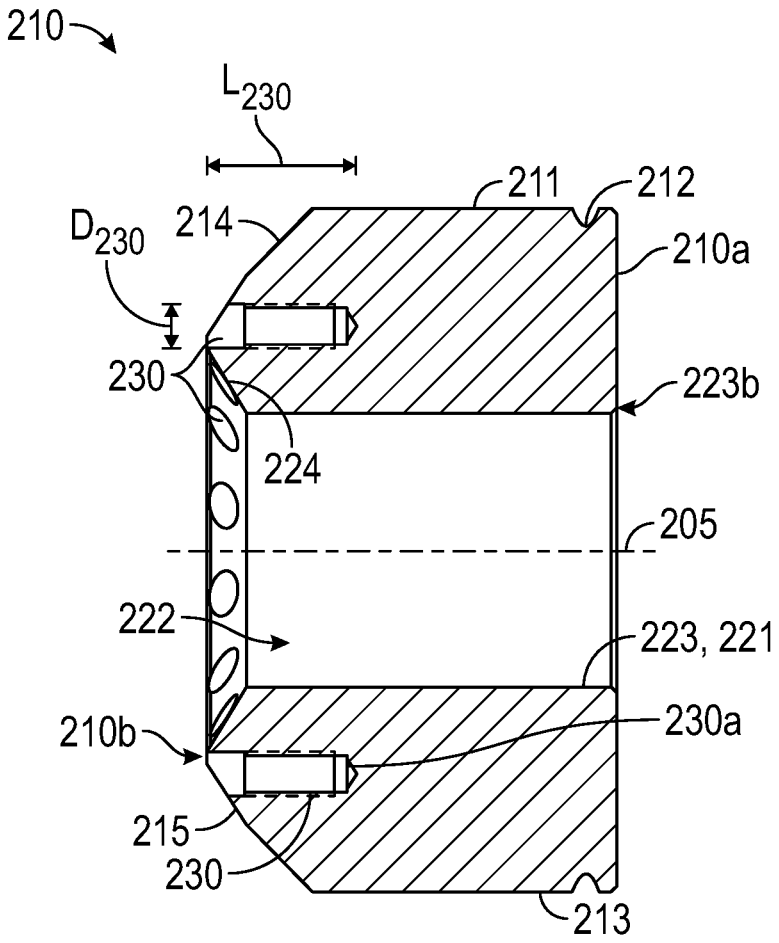
FIG. 6 is a cross-sectional side view of the mandrel of FIG. 4.
Figure 7:
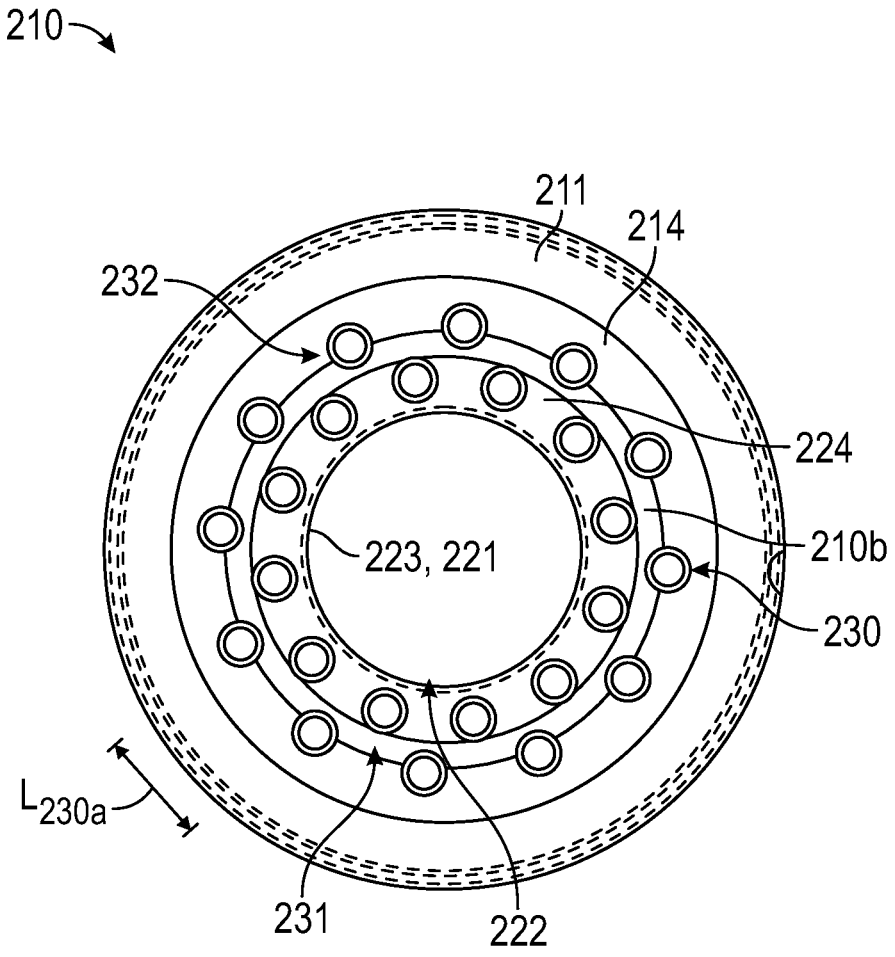
FIG. 7 is an end view of the mandrel of FIG. 4.
Figure 8:
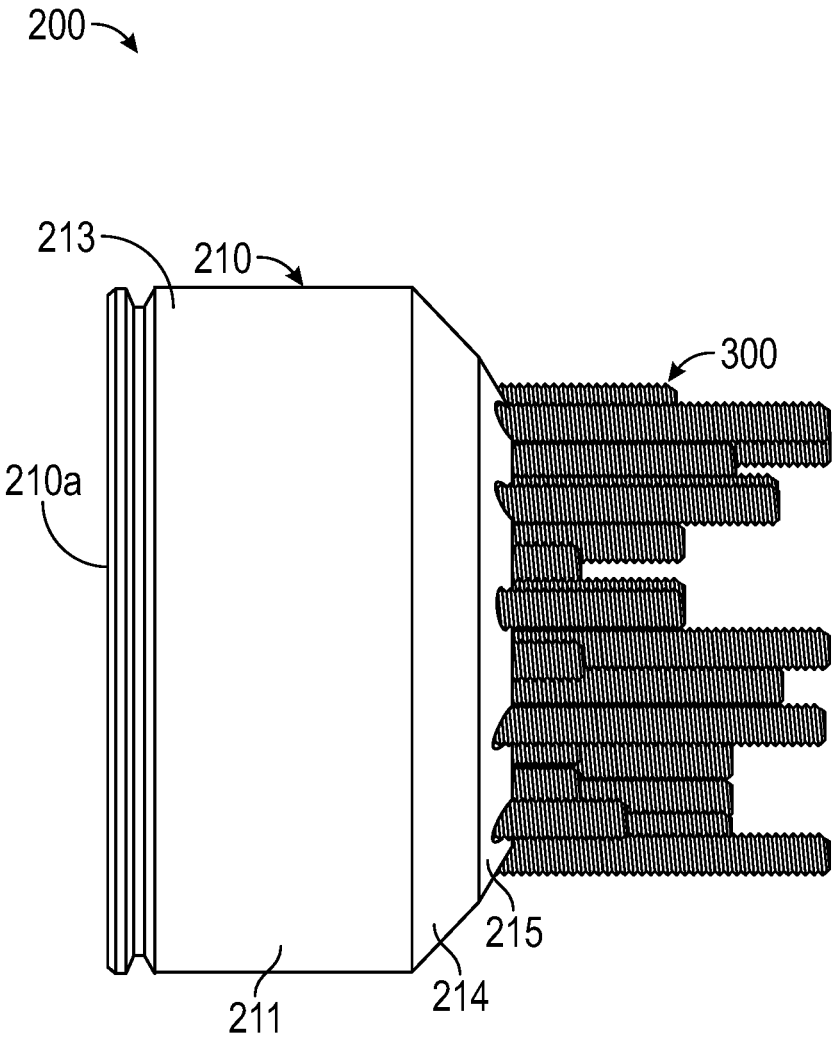
FIG. 8 is a side view of the modular bit blank assembly of FIG. 4.

Referring now to FIG. 4, in this embodiment, blank assembly 200 includes an annular mandrel 210 and a plurality of elongate fingers or studs 300 fixably secured to mandrel 210. Mandrel 210 is generally cylindrical and has a central axis 205 coincident with bit axis 105. As best shown in FIGS. 5-7, mandrel 210 has a first or upper end 210*a*, a second or lower end 210*b* opposite end 210*a*, a radially outer surface 211 extending axially between ends 210*a*, 210*b*, and a radially inner surface 221 extending axially between ends 210*a*, 210*b*. Inner surface 221 defines a through bore 222 extending axially through mandrel 210. Outer surface 211 includes an annular recess or indentation 212 axially adjacent upper end 210*a*, a cylindrical surface 213, a first outer frustoconical surface 214, and a second outer frustoconical surface 215. Cylindrical surface 213 extends axially from recess 212 to first outer frustoconical surface 214, and second outer frustoconical surface 215 extends axially from end 210*b* to first outer frustoconical surface 214. Inner surface 221 includes a cylindrical surface 223 extending axially from end 210*a* and an inner frustoconical surface 224 extending axially from surface 223 to end 210*b*. Surfaces 213, 214, 215, 223, 224 are concentrically disposed about axis 205. Frustoconical surfaces 215, 224 intersect at end 210*b*. As will be described in more detail below, surfaces 214, 215, 223, 224 engage crown 500. Although surfaces 214, 215, 223, 224 are generally smooth in this embodiment, in other embodiments, one or more of surfaces 214, 215, 223, 224 can be textured or include surface features (e.g., recesses, protrusions, threads, grooves, etc.) to enhance contact surface area with crown 500, thereby enhancing torque strength and holding power against relative movement. vertical separation from the crown (now shown).

Referring still to FIGS. 5 through 7, mandrel 210 also includes a plurality of parallel counterbores or bores 230 extending axially from end 210*b*. Bores 230 are arranged in two annular rows—a first or inner annular row 231 of circumferentially-spaced parallel bores 225 extending axially from inner frustoconical surface 224 and a second or outer annular row 232 of circumferentially-spaced parallel bores 225 extending axially from outer frustoconical surface 215. In this embodiment, bores 230 in inner row 231 are uniformly circumferentially-spaced, and bores 230 in outer row 232 are uniformly circumferentially-spaced. In addition, bores 230 in inner row 231 are circumferentially staggered relative to bores 230 in outer row 232. Thus, one bore 230 in inner row 231 is azimuthally or angularly positioned between each pair of circumferentially adjacent bores 230 in outer row 232.

As best shown in FIG. 6, each bore 230 in row 231 extends axially from surface 224 to a bore bottom or end 230*a* and each bore 230 in row 232 extends axially from surface 215 to a bore bottom 230*a*. As best shown in FIG. 6, each bore 230 has a depth $L_{230}$ measured axially from end 230*a* to end 210*b*. Each depth $L_{230}$ is preferably between 0.4 and 1.0 inch. In this embodiment, each bore 230 is generally cylindrical, internally threaded, and has the same diameter $D_{230}$. In particular, each bore 230 has a diameter $D_{230}$ preferably between 0.25 and 0.6 inches. In addition, as best shown in FIG. 7, each pair of circumferentially adjacent bores 230 in each row 231, 232 are circumferentially-spaced spaced apart by a distance $L_{230a}$ preferably greater than or equal to the width or diameter of each bore 230. Although bores 230 are generally cylindrical, internally threaded, have the same dimensions (e.g., depth $L_{230}$ and diameter $D_{230}$), and geometry in this embodiment, in other embodiments, one or more of the bores (e.g., bores 230) can have different geometries, shapes (e.g., rectangular, oblong, triangular, or other geometric-shaped cross section), dimensions, coupling means (e.g., threaded or include grooves or any other mating mechanism known in the art), or combinations thereof.

Although two rows 231, 232 of bores 230 are provided in mandrel 210, in other embodiments, greater or fewer rows of bores (e.g., bores 230) can be used. For example, only one circumferentially equidistant spaced row of bores may be used in one embodiment and in another embodiment with a larger bit diameter, three or more circumferentially equidistant spaced rows of bores 230 may be used. The mandrel 210 can be made from any material standard in the art including, but not limited to, mild steel (e.g., 1018 steel), alloy steel (e.g., 4140 steel), 17-4 PH stainless steel, or tool steel (e.g., A2 or D2).

Figure 13A:
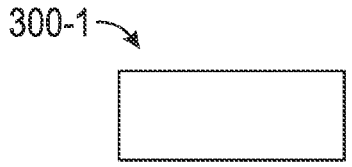
FIGS. 13A-13C are cross-sectional end views of embodiments of fingers for a modular bit blank assembly in accordance with the principles disclosed herein.
Figure 13B:
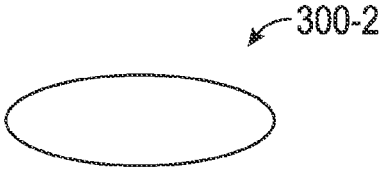
Figure 13C:
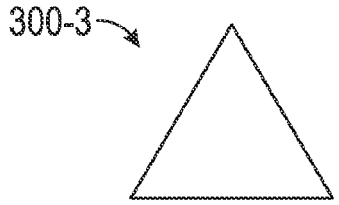
Figure 13D:
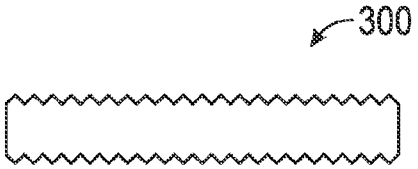
FIGS. 13D-13F are cross-sectional side views of embodiments of fingers for a modular bit blank assembly in accordance with the principles disclosed herein.
Figure 13E:
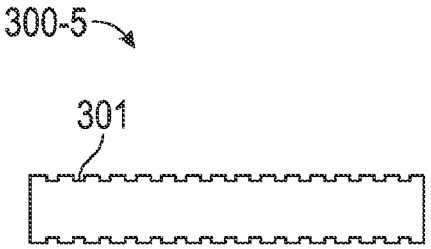
Figure 13F:
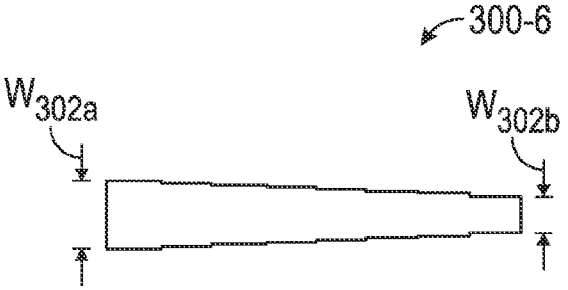

Referring now to FIGS. 4 and 8-11, as previously described, bit blank assembly 200 includes mandrel 210 and a plurality of elongate fingers 300 fixably secured to mandrel 210. Fingers 300 are generally sized to mate and engage with bores 230. Thus, in this embodiment, each finger 300 generally cylindrical, externally threaded, and has a diameter $D_{300}$ preferably between 0.25 and 1.0 inch. However, each finger 300 has a length $L_{300}$ measured axially between its ends and greater than depth $L_{230}$ of the corresponding bore 230 such that fingers 300 extend axially therefrom. In this embodiment, fingers 300 have variable lengths $L_{300}$, and thus, extend axially to different distances from mandrel 210. In general, length $L_{300}$ of each finger 300 is preferably between 2.0 and 10.0 inches. Although fingers 300 are generally cylindrical, externally threaded, have the same diameter (e.g., diameter $D_{300}$) with varying lengths (e.g., length $L_{300}$) in this embodiment, in other embodiments, one or more of fingers (e.g., fingers 300) can have different geometries, shapes (e.g., rectangular, oblong, triangular, or other geometric-shaped cross section), dimensions, coupling means (e.g., threaded or include grooves or any other mating mechanism known in the art), or combinations thereof. In other embodiments, the fingers (e.g., fingers 300) can have other geometries and dimensions (e.g., alternative cross-sectional shapes, alternative profiles, etc.), but are preferably shaped and sized to mate with corresponding bores (e.g., bores 230) in the mandrel (e.g., mandrel 210). For example, FIGS. 13A-13F illustrate exemplary alternative embodiments of fingers that can be used in modular bit blank assemblies. Referring first to FIGS. 13A-13C, fingers 300-1, 300-2, 300-3 having alternative cross-sectional geometries are shown. In particular, finger 300-1 shown in FIG. 13A has a rectangular cross-section; finger 300-2 shown in FIG. 13B has an oval cross-section; and finger 300-3 shown in FIG. 13C has a triangular cross-section. Referring now to FIGS. 13D-13F, fingers 300, 300-5, 300-6 having alternative outer profiles are shown. In particular, finger 300 as previously described is shown in FIG. 13D and has a cylindrical outer surface that is externally threaded; Finger 300-5 shown in FIG. 13E has a cylindrical outer surface that include a plurality of uniformly axially spaced annular recesses or grooves 301; and Finger 300-6 shown in FIG. 13F has a tapered frustoconical outer surface with a width $W_{302a}$ at one end that is larger than the width $W_{302b}$ of the opposite end.

Figure 11:
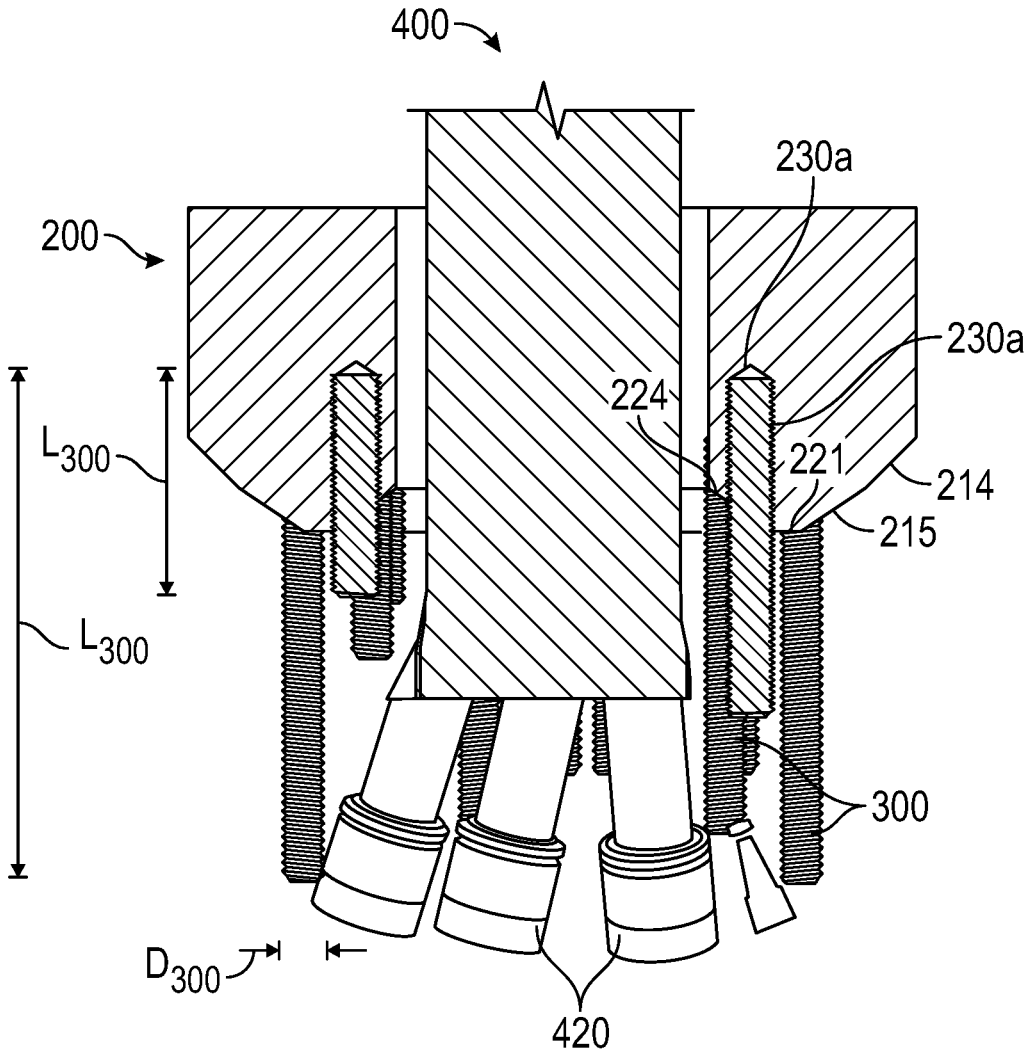
FIG. 11 is a cross-sectional view of the modular bit blank assembly and nozzle spacer of FIG. 10.

As shown in FIG. 11, each finger 300 is secured to mandrel 210 via threaded engagement with one mating bore 230. Each finger 300 axially abuts the corresponding bore bottom 230*a* and each extends axially downward beyond end 210*b* of mandrel 210. The axial distance each finger 300 extends from mandrel 210 depends on the overall length $L_{300}$ of the finger 300. The selection of each finger 300 for each bore 230 depends on the finger length $L_{300}$ and will be described in further detail below.

Although fingers 300 are threaded into bores 230 in this embodiment, in other embodiments, the fingers (e.g., fingers 300) can be coupled to the mandrel (e.g., mandrel 210) by other suitable means known in the art including, but not limited to, slip fit, interference fit, press fit, welding, or combinations thereof. Further, although fingers 300 have uniform diameters $D_{300}$ in this embodiment, in other embodiments, different sizes and shaped fingers (e.g., fingers 300) can be used in any combination. For example, if the nozzle configuration does not allow many fingers 300 to be used, a smaller diameter finger or an oblong cross-sectional finger may be used. The fingers 300 can be made from any material standard in the art including, but not limited to, mild steel (e.g., 1018 steel), alloy steel (e.g., 4140 steel), 17-4 PH stainless steel, or tool steel (e.g., A2 or D2).

Figure 12:
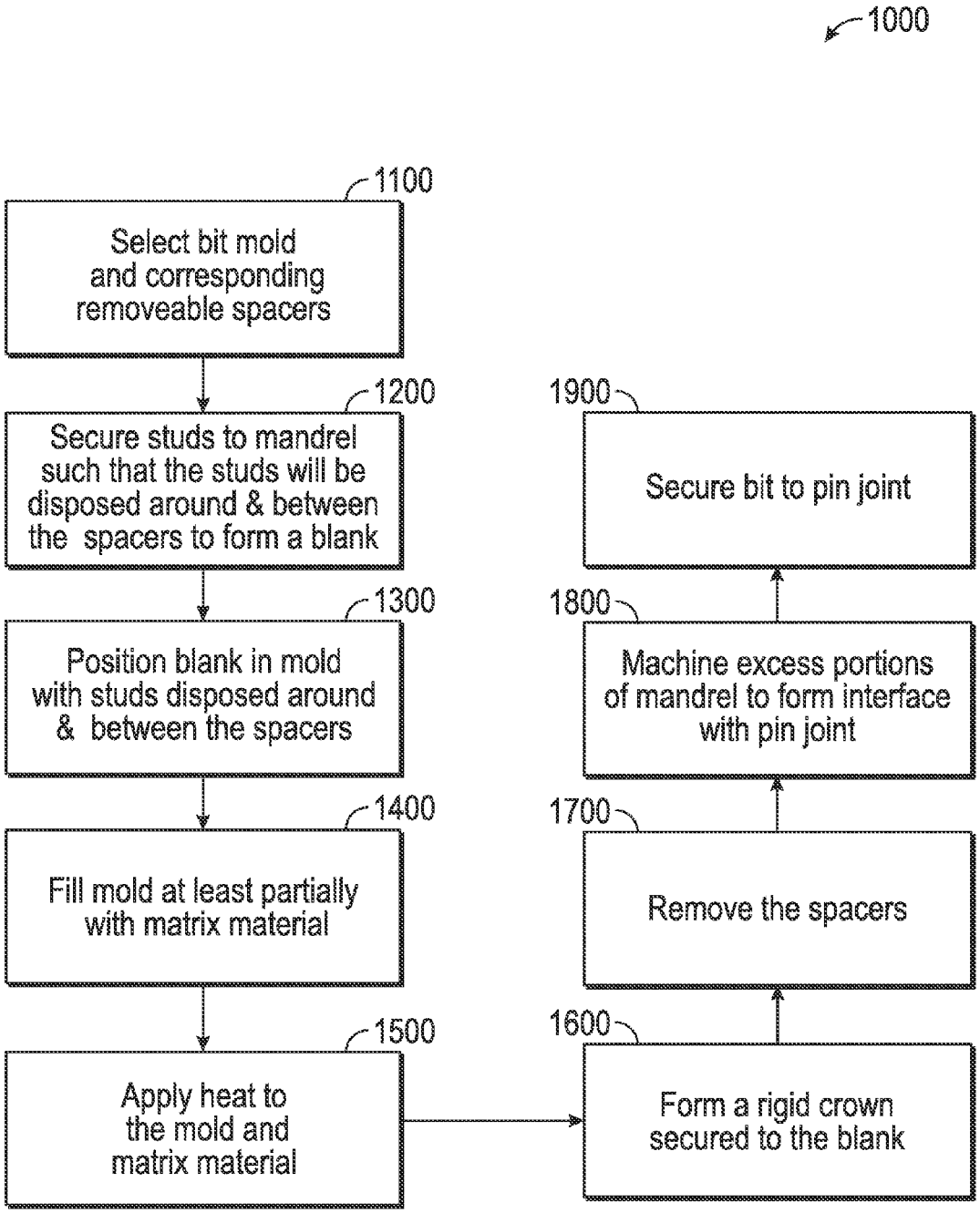
FIG. 12 is a flow diagram of an embodiment of a method for manufacturing a drill bit in accordance with the principles disclosed herein.

Referring now to FIG. 12, an embodiment of a method 1000 for manufacturing bit 100 previously described is shown. Though depicted sequentially as a matter of convenience, at least some of the steps shown in FIG. 12 can be performed in a different order and/or performed in parallel.

Figure 9:
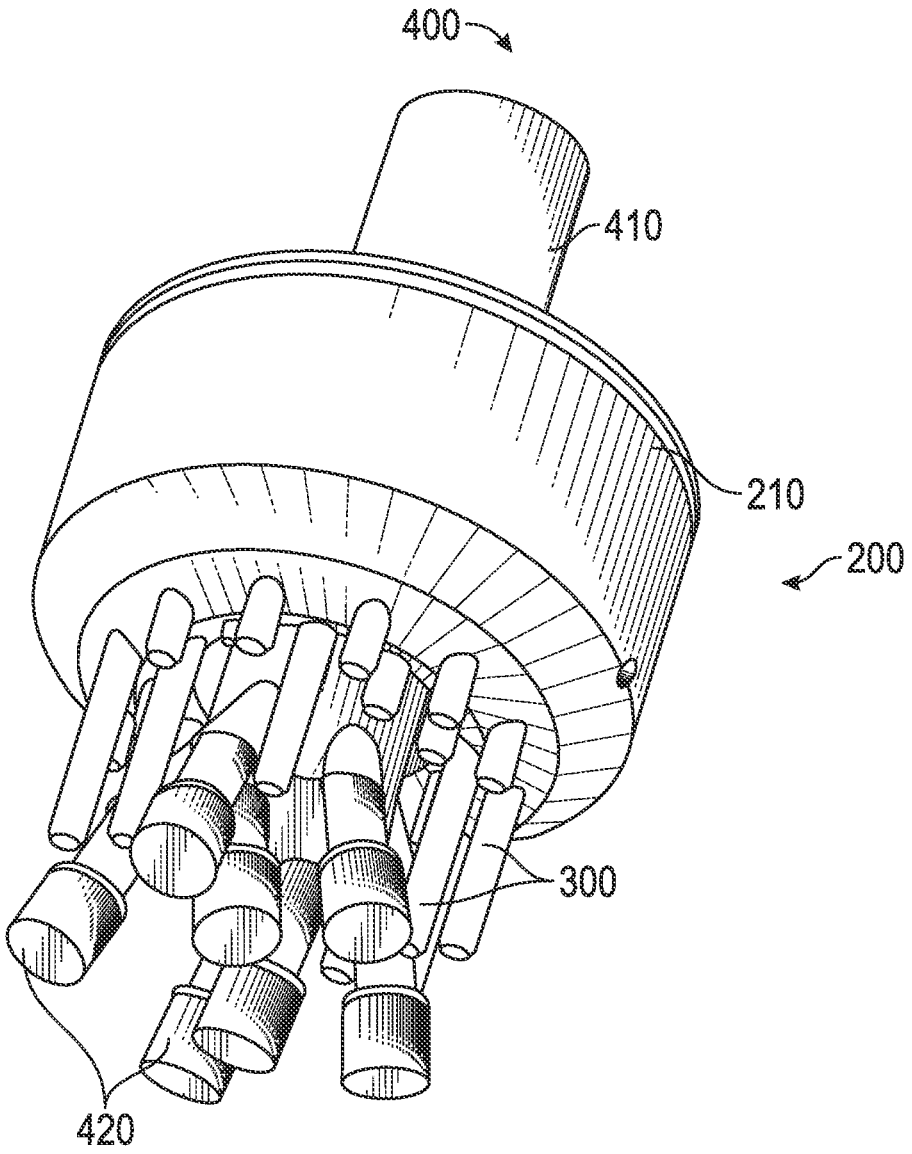
FIG. 9 is a perspective view of the modular bit blank assembly of FIG. 3 and a nozzle spacer used during manufacture of the bit of FIG. 2.
Figure 10:
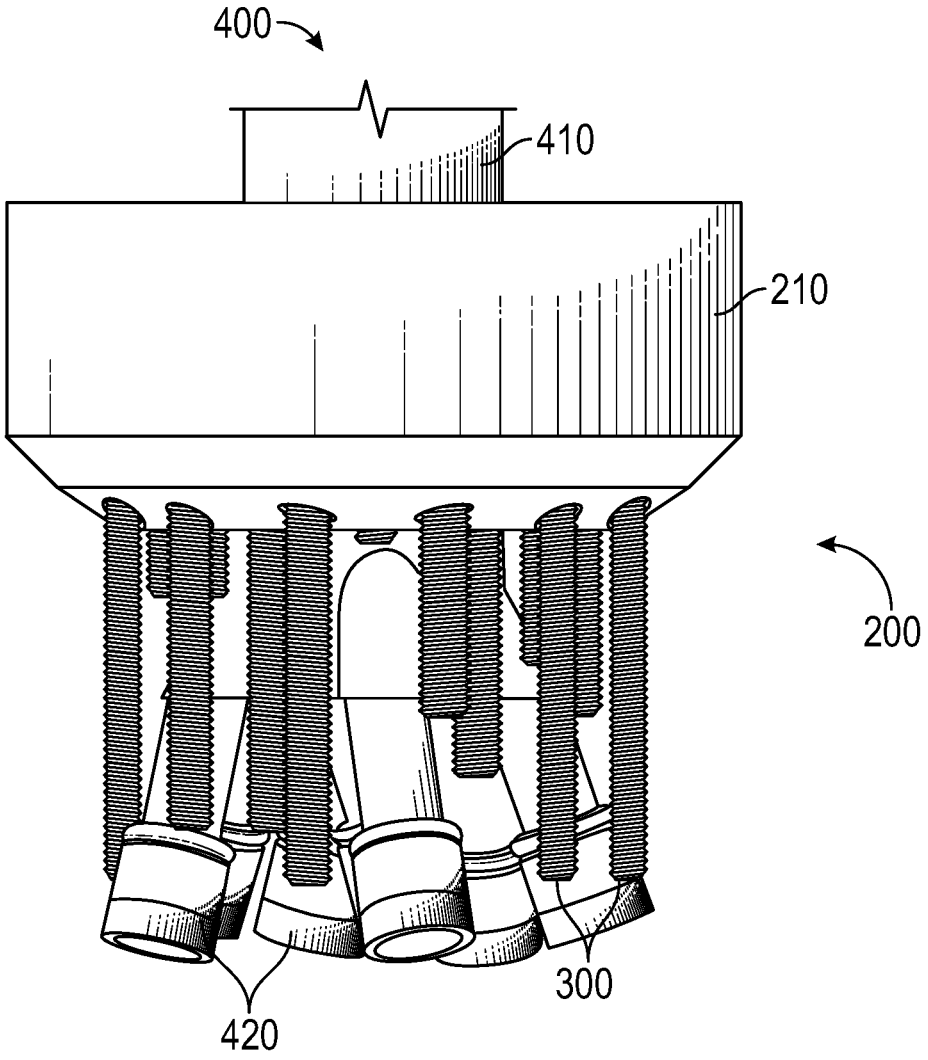
FIG. 10 is a side view of the modular bit blank assembly and nozzle spacer of FIG. 9.

Referring now to FIGS. 9-12, starting in block 1100, a bit mold (not shown) and corresponding removable spacers or inserts 400 are selected. In general, any bit mold and removable spacers standard in the art may be used, but will depend on the ultimate design and layout of bit 100. Removable spacers or inserts 400 can be made from any material standard in the art including, but not limited to sand, graphite, or any material that will hold a shape through the casting process. In block 1200, the fingers or studs 300 are secured to the mandrel 210 such that the studs 300 will be disposed around and between the spacers or inserts 400 to form a blank 200. FIGS. 9-11 illustrate fingers 300 of varying lengths $L_{300}$ disposed about spacer 400 having one large cylindrical portion 410 at the upper end and a plurality of generally cylindrical extensions 420 extending from the large cylindrical portion 410. The large cylindrical portion 410 and extensions 420 are spacers for forming drilling fluid passages 150,151, respectively, in bit body 100 as previously described and shown in FIG. 3.

As previously described, each finger 300 is disposed in a bore 230 and fixably coupled to mandrel 210 to form bit blank assembly 200. The length $L_{300}$ of the studs 300 is based partly on the configuration of the removable spacers 400—the studs 300 preferably extend axially as far from mandrel 210 as possible while maintaining sufficient clearance around extensions 420 and without contacting bit face 120. The length $L_{300}$ of fingers 300 is also based partly on the size of the bit mold—as the gage length of the bit increases, the length $L_{300}$ of the studs 300 will generally also increase. In other words, fingers 300 are circumferentially positioned and sized (length $L_{300}$ and diameter $D_{300}$) so that fingers 300 do not interfere with extensions 420 and extend axially as much as possible to enhance engagement between bit blank assembly 200 and crown 500.

Referring again to FIG. 12, in block 1300, bit blank assembly 200 is positioned in the mold with studs 300 disposed around and between the spacers 400. In block 1400, the mold is filled at least partially with matrix material. Any matrix material standard in the art may be used including, but not limited to, soft powder (e.g., tungsten-infiltrated matrix), hard powder, and binder. In block 1500, heat is applied to the mold and matrix material. When the bit body 110 is being heated, each finger 300 is isolated such that during heating and subsequent expansion of the finger 300 and later cooling and subsequent contraction of the finger 300, the expansion of the matrix is more localized. Thus, the hoop stress can be localized and kept away from the nozzles and other locations where material from the bit body 110 is removed (e.g., wherever spacer 400 is located); thus, reducing the issue of stress and cracking in the bit body 110. In block 1600, a rigid crown is formed and secured to the blank 200. In block 1700, the spacers 400 are removed. The spacers may be removed through any process standard in the art. In block 1800, excess portions of mandrel 210 are machined off to form an interface with pin joint or connection member 190. In block 1900, the bit 100 is secured to a pin joint 190. The bit 100 may be secured to pin joint 190 by any means standard in the art including, for example, but not limited to, welding, shrink fit, or press fit.

The modular bit blank assembly 200 overcomes the thermal issues associated with the manufacturing process while accommodating most any bit design. As previously described, the mold for matrix bits must be created or machined and the bit blank is made from steel or other suitable material is prepared and disposed within the mold cavity. The modular bit blank assembly 200 accommodates any configuration of spacers 400 (i.e., cylindrical portion 410 and plurality of cylindrical extensions 420) by adjusting the length of fingers 300 positioned around the spacer. Thus, a single mandrel 210 (for a given bit size) may be used to custom design and create any drill bit design or layout. The use of a universal mandrel 2120 and a plurality of fingers 300 also reduces the potential for stress and cracking in the bit body resulting from the thermal impact of the manufacturing processes.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A fixed cutter drill bit for drilling a borehole in earthen formations, the bit having a central axis and a cutting direction of rotation, the bit comprising:

a blank assembly including an annular mandrel and a plurality of elongate studs fixably coupled to the mandrel;

a matrix crown fixably mounted to the blank assembly;

wherein the mandrel is coaxially aligned with the central axis and has a first end distal the crown and a second end engaging the crown;

wherein the mandrel includes a plurality of bores extending axially from the second end;

wherein each elongate stud has a first end disposed within one of the bores and a second end disposed in the crown distal the mandrel; and wherein at least one elongate stud has a different length than the other elongate studs of the plurality of elongate studs.

2. The fixed cutter drill bit of claim 1, wherein the plurality of bores is arranged in a row and circumferentially spaced.

3. The fixed cutter drill bit of claim 2, wherein the plurality of elongate studs is arranged in more than one row.

4. The fixed cutter drill bit of claim 1, wherein each bore of the plurality of bores is oriented parallel to the other bores of the plurality of bores.

5. A blank assembly for a fixed cutter drill bit, the blank assembly comprising:

an annular mandrel having a central axis, a first end, and a second end axially opposite the first end, wherein the mandrel includes a plurality of parallel bores extending axially from the second end; and a plurality of elongate studs fixably secured to the mandrel, wherein each stud has a first end seated in one of the bores and a second end distal the mandrel;

wherein the plurality of elongate studs is arranged in more than one row.

6. The blank assembly of claim 5, wherein the plurality of bores is arranged in a row and circumferentially spaced.

7. The blank assembly of claim 5, wherein each bore of the plurality of bores is oriented parallel to the other bores of the plurality of bores.

8. The blank assembly of claim 5, wherein at least one elongate stud has a different length than the other elongate studs of the plurality of elongate studs.

* * * * *